US006333966B1

(12) United States Patent
Schoen

(10) Patent No.: US 6,333,966 B1
(45) Date of Patent: Dec. 25, 2001

(54) LASER ACCELERATOR FEMTOSECOND X-RAY SOURCE

(76) Inventor: Neil Charles Schoen, 9817 Freestate Pl., Gaithersburg, MD (US) 20886

( * ) Notice: Subject to any disclaimer, the term of this patent is extended or adjusted under 35 U.S.C. 154(b) by 0 days.

(21) Appl. No.: 09/481,874

(22) Filed: Jan. 12, 2000

Related U.S. Application Data

(63) Continuation-in-part of application No. 09/135,164, filed on Aug. 18, 1998, now abandoned.

(51) Int. Cl.[7] ..... H01J 35/00
(52) U.S. Cl. ..... 378/119; 378/121; 378/122
(58) Field of Search ..... 378/119–122, 136–143, 378/145, 84, 34, 113; 372/5

(56) References Cited

U.S. PATENT DOCUMENTS

| | | | | |
|---|---|---|---|---|
| 3,822,410 | * | 7/1974 | Madey | 378/119 X |
| 4,570,103 | * | 2/1986 | Schoen | 315/4 |
| 5,077,774 | * | 12/1991 | Piestrup et al. | 378/119 |
| 5,495,515 | * | 2/1996 | Imasaki | 378/119 |
| 5,606,588 | * | 2/1997 | Umstadter et al. | 378/119 |
| 5,930,331 | * | 7/1999 | Rentzepis et al. | 378/136 |

* cited by examiner

*Primary Examiner*—David P. Porta

(57) ABSTRACT

A technology for generating femtosecond time regime x-ray pulses for application to the study of the structure and reactions of biological molecules, photosynthesis reactions, semiconductor device fabrication, structural determination and dynamic performance, and other chemical, biological and physical processes taking place on sub-picosecond time scales. Electrons are accelerated to hundreds of keV to tens of MeV energies using high energy, femtoseconds duration laser pulses, and are then converted to x-rays by one of several physical processes. Because the laser accelerated electrons have the pulse width of the laser driver, extremely short (less than 100 femtoseconds) x-ray pulses can be produced from these electrons. The x-ray energy and emittance can be controlled by electron beam production and beam transport techniques and/or collimators or x-ray optical systems. The use of laser acceleration and novel electron to x-ray conversion processes should result in significantly lower costs than current synchrotron-based x-ray sources, and lead to widespread introduction of this tool into commercial biological and medical x-ray and materials structure research laboratory environments. In addition, multi-beam sources of electrons from conventional electron devices, such as field emission diodes and thermionic emission devices, can be used in conjuction with novel x-ray beam combining techniques to produce a long pulse, high flux collimated x-ray beam suitable for use in biological x-ray crystallography studies.

14 Claims, 10 Drawing Sheets

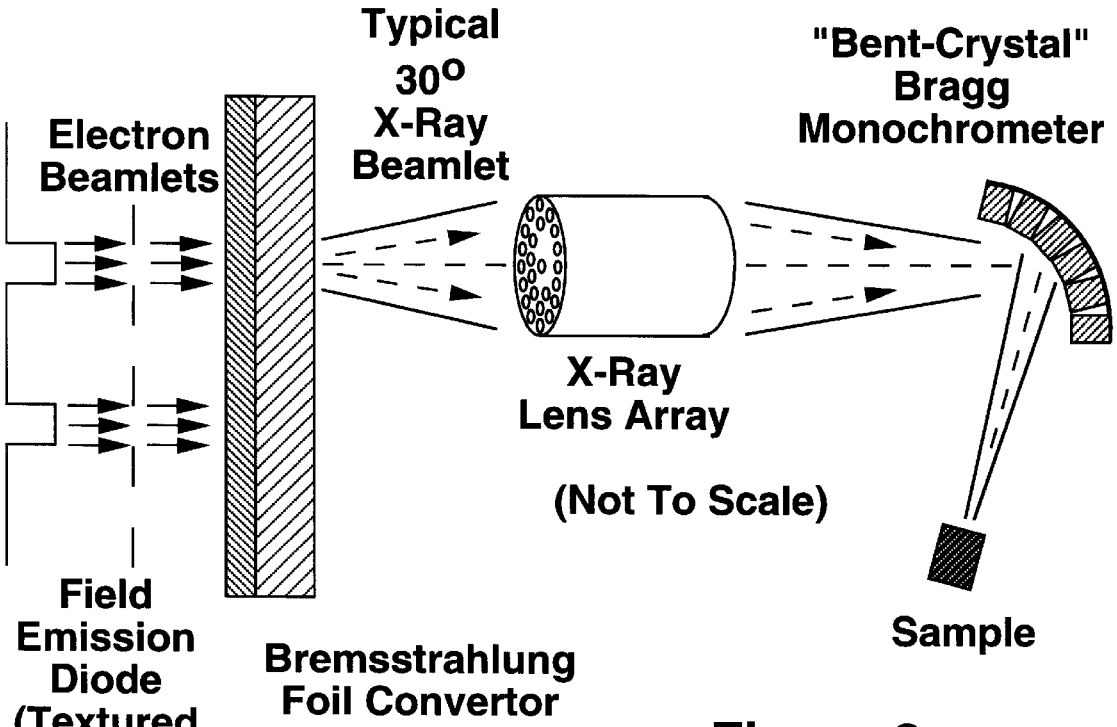
Figure 8
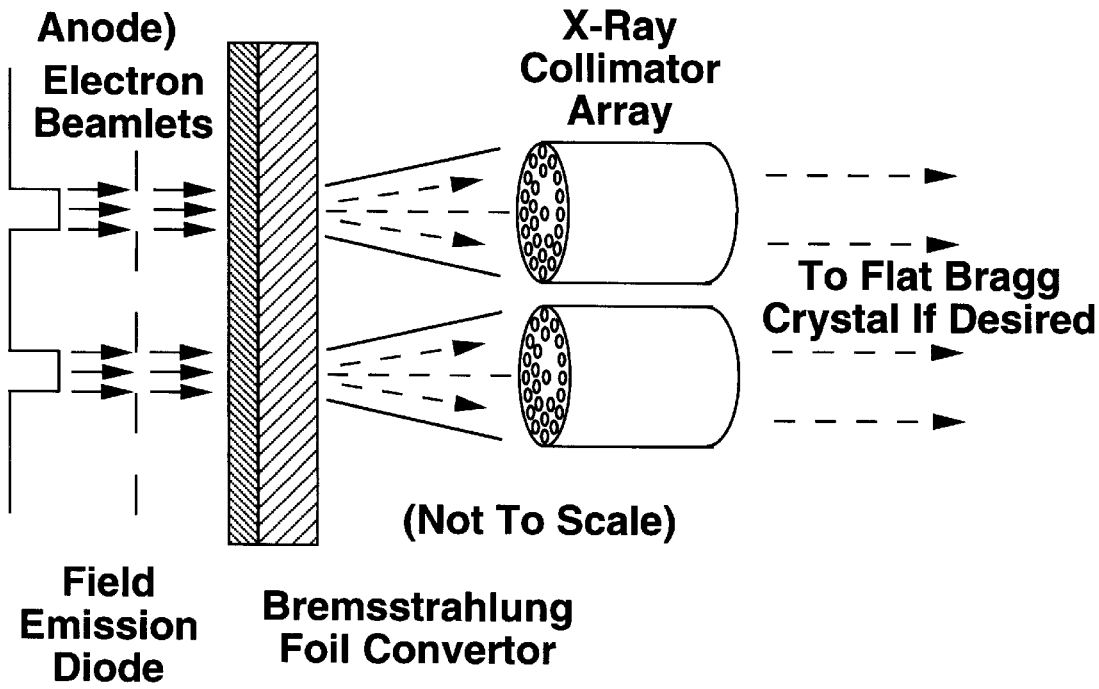

(Not To Scale)
Electron Sources
Electron Beam
Thermionic Cathode
Needle (CW)
Quadrupole Triplet
Field Emission Diode (Pulsed)
Electron Spot Patterns
Single Beam
Multiple Beamlet Array
Needle Array (CW)
Field Emission Diode (Pulsed)
Electron Beam
V
V
Raster Scan Beamlet Array

LASER ACCELERATOR FEMTOSECOND X-RAY SOURCE

This application is a continuation-in-part of prior application 09/135,164 filed on Aug. 18, 1998, now abandoned.

The concept and feasibility of using the extremely high electro-magnetic fields achievable in the Rayleigh region around the focal plane of a multi-Joule short pulse laser to accelerate electrons to multi-MeV energies was first developed by Schoen in the mid 1980s, and experimental confirmation followed with the advent of femtosecond regime high power lasers in the early 1990s. Details of this work appear in the cited references. These developments could lead to the design and fabrication of table-top electron accelerators, with concomitant low costs when compared with synchrotrons that currently are necessary to provide low emittance high energy electron beams.

With the advent of these compact low cost electron sources, it should now be possible to develop the technology for using these multi-MeV electrons to produce extremely short pulse x-rays, which can be used for several applications, including x-ray crystallographic and absorption techniques to study the structure and reaction dynamics of biological molecules, for high resolution medical x-rays, and for structural studies and process techniques in the semiconductor manufacturing area. The integration of several novel techniques to accomplish the above objectives, and performance estimates, appears in the following sections.

BACKGROUND

X-ray sources have been in use for medical and physics research applications since the discovery of x-rays by William Roentgen at the turn of the century. Early sources were based on acceleration of electrons in an x-ray vacuum tube (using high voltage power supplies) and their subsequent collision with a cooled metal anode, which produced K- and L-edge x-ray line emission from the metal (usually copper) atoms in addition to continuum radiation from Bremsstrahlung radiation. The shape and duration of the x-ray pulse was limited by the inductive rise time of the electron tube circuitry (in the microsecond range) for the pulse leading edge, and the power supply and cooling capability for the pulse duration.

With the advent of the electron beam accelerators in the 1930s and 1940s, a new shorter pulse time domain opened up as a result of the "bunched" nature of electron beams in cyclotron and synchrotron electron accelerators, due to the time and phase restrictions of repetitive geometry accelerating structures. Electron bunches of the order of picoseconds are now routine in the current generation of electron accelerators. However, these machines are usually very large and expensive (>$10 million for low energy machines), and are currently confined to government laboratories for basic research applications.

The introduction of lasers (in the 1960s) has led to several techniques to produce x-ray pulses, based on the ability to focus laser beams to very high powers over small areas (microns). One recent technique involves short-pulse lasers to create a plasma by focusing the light onto a thin foil, which is heated to several thousand or more degrees over a region of several microns in a time very short compared to the thermal diffusivity of the foil. This plasma then radiates as a black body, producing an x-ray spectrum with energy spread dependent on the temperature of the plasma. However, this technique results in x-ray emission over 4 pi steradians, or isotropic radiation, and thus the x-ray flux drops rapidly with distance from the source (roughly as $1/r^2$). More importantly, the x-ray pulse length depends on the plasma thermodynamic properties, which are not easily controlled, and this results in x-ray pulses significantly longer than that of the laser driver, as demonstrated by the Umstadter, et. al. patent.

The use of laser accelerator electrons combined with novel x-ray conversion in this invention should provide advantages in the intensities of the x-rays produced and the angular distribution of x-rays. These features, coupled with the very short pulse duration will open up new capabilities for research and materials processing. For example, reaction kinetics and related molecular structure changes for a variety of important biological molecules could be studied, since many of these processes occur on picosecond time scales. Photosynthesis reactions in particular involve electron transfers at molecular sites that are known to be sub-picosecond processes. The very short x-ray pulses also can "freeze" molecular structures for x-ray diffraction studies. Another potential application is the study of the disordering and re-ordering (annealing) of semiconductor surface layers after rapid "melting" by short laser pulses followed by x-ray probes of the layer behavior. The effects of "hot electrons" injection in semiconductor devices could also be studied using the above laser techniques. Finally, changes in the above-K-edge absorption of x-rays (EXAFS) can be used to examine changes in short range structure at molecular sites, even for "amorphous" collections of molecules (as is the case in fluids, as opposed to crystalline structures).

SUMMARY OF THE INVENTION

The invention described herein is a novel integration of several individual technologies developed originally for the high energy particle physics community, to provide low cost fast x-ray sources not presently available from commercial or laboratory organizations. The laser accelerator femtosecond x-ray source (LAFXS) is based on an electron acceleration technique developed by the inventor, and recently confirmed experimentally in the U.S. and Europe. The use of a high peak power short pulse laser, focused to diffraction limited size, provides extremely high electric and magnetic fields which can accelerate electrons via the ponderomotive force to energies of the order of 100 MeV in axial distances of the order of the Rayleigh range, as indicated in the Schoen patent cited reference. A description of the basic components of the LAFXS is as follows.

In order to accelerate electrons to 50 MeV or higher energies, laser peak powers approaching $10^{21}$ Watts/cm$^2$ may be necessary. The development of chirped pulse amplification ( see article by D. Strickland and G. Mourou, Optical Communications, Vol. 56, 219, (1985) for example) now enable these high peak powers to be achieved in a Rayleigh region focus, with durations of the order of several hundred femtoseconds down to as few as 50 femtoseconds. The laser used for accelerating electrons consists of a mode-locked glass laser (e. g., NdYAG) which feeds pulses into a chirped pulse amplifier (CPA). The CPA is a pulse stretching optical cavity, between two frequency gratings, with a filtering mask within the cavity to modify the phase and/or amplitude of each frequency component of the input pulse spatially separated by the grating. The pulse components exiting the grating enter an amplifier and then a pulse re-compressor to produce the required femtoseconds duration, high intensity focal spot. A gas jet can provide the source of electrons, via ionization by the intense laser pulse. The electrons are accelerated to high energies by the ponderomotive force of the laser beam; those with the highest initial axial velocity reach the highest energies, as described in the previous references and figures in the following section. Electron acceleration can also take place via a plasma wake field or beat wave process, although indications from recent experiments imply that only the lower energy electrons (e.g., those up to a few MeV) are created by this mechanism. It is also possible that these lower energy electrons produced by plasma waves serve as a source for the ponderomotive acceleration to high energies, since electrons with high initial axial velocities will be accelerated to the multi-MeV (of the order of 50 MeV) energies observed, as calculated via computer simulation in the referenced patent.

The electrons produced can be transported to an x-ray conversion region via standard electron optics elements, including focusing quadrupole magnets and dipoles for energy spectrometry/filtering. Electron beam optics designs from synchrotrons could also be used to accommodate the momentum spread of the electrons to produce a spatial focus of all electrons regardless of momentum (the equivalent of an achromatic optical lens system). Alternatively, the x-ray conversion region can be placed in close proximity to the electron production region, thus preserving the small cross section of the electrons (approximately the size of the laser focal spot). A primary advantage of the Bremsstrahlung process is the preservation of the femtoseconds electron pulse width, since the x-ray conversion takes place in a very thin high Z foil, and thus the transit time of the electrons in the foil is comparable to the electron pulse width. Another advantage is the relatively high conversion efficiency as compared to other techniques to be discussed herein.

The final component of the LAFXS is the x-ray converter and x-ray optics. Preliminary calculations indicate that a thin high Z (e.g., tungsten or tantalum) material metal foil Bremsstrahlung conversion technique will provide the highest x-ray flux with minimum beam divergence. The x-ray beam can be re-focused and collimated to provide the uniformity and energy spread necessary for the particular application desired. In addition, innovative beam combining x-ray optics have been employed to create a single high flux x-ray beam from multiple x-ray beamlets. This allows the use of more conventional electron beam sources, which have thermal-limited current densities, to be employed to create x-ray fluxes approaching those available from synchrotron sources. A key feature of the x-ray beam combing optics is a multi-faceted Bragg crystal that can collect x-rays from ten or more separate beams. Use of polycapillary x-ray collimating lenses and Bragg crystal for energy selection results in a beam combining technique that can produce acceptable spot sizes and angular divergences for use in biological x-ray crystallography applications.

There are several other techniques to produce x-rays from the high energy electrons but most have drawbacks in terms of cost, flux or pulse length. For example, it is to utilize Thomson scattering off the electrons by a second laser beam, which will produce a Compton effect up-shift in photon energy to x-ray wavelengths. Thomson scattering of laser beams has long been used as an electron energy diagnostic by the plasma physics and nuclear fusion communities, and recently by researchers at DoE laboratories for synchrotron X-ray sources. Although it is possible to replace a synchrotron electron source with a laser accelerated electron source and obtain shorter x-ray pulses (due to the smaller electron beam size) as well as a much more compact and inexpensive device, calculations that follow indicate Thomson scattering is less efficient than Bremsstrahlung techniques. Finally, it is also possible to utilize techniques such as magnetic "wigglers" and undulators, currently at use at synchrotron facilities to convert a portion of the high energy electron kinetic energy to x-rays via a free electron laser (FEL) conversion process. However, this process scales as $\gamma^2$ times the wiggler periodic wavelength $\lambda_w$, and is more suitable for GeV electrons. The efficiency of the process is also low and requires the high electron beam currents.

Finally, another embodiment of the invention described herein utilizes a different type of electron beam source, which although it can not produce short, sub-picosecond pulses, nevertheless provides multi-kiloamp electron beam pulses of the appropriate energy for x-ray conversion (tens to hundreds of kilovolts). This embodiment employs a capacitive storage device which is coupled to a field emission diode via a triggerable switch (e.g., a trigatron or laser-triggered spark switch). A high current electron pulse can be extracted through a thin foil anode, the duration of which depends on the ion transit time across the field emission diode, which is typically of the order of fifty to one hundred nanoseconds. The use of another innovation described in this invention, that of x-ray beam combining optics, will also allow use of more conventional thermionic emission electron sources (current limited due to x-ray producing anode thermal melting), which can overcome this problem through the use of multiple electron beam sources. These electron beam devices are patterned after standard electron gun designs with additional electron acceleration devices, such as the Pierce gun followed by an Einzel lens to accelerate the electrons to higher voltages. The back ends of these x-ray sources can be identical in nature to that of the laser accelerator femtosecond pulse device described previously. The novel feature of these devices is the extremely high electron currents which result in high x-ray fluxes via high Z Bremsstrahlung foil convertors. Note that the Piestrup patent cited claims a low Z (i.e., beryllium), multi-foil stack that produces transition radiation x-rays, as opposed to the single convertor foil, high Z Bremsstrahlung conversion process of the present invention.

DESCRIPTION OF THE FIGURES

FIG. 8. shows details of a field emission diode textured cathode design, along with x-ray lens and x-ray collimator optical components based on prior art polycapillary techniques designed to maximize collection of diverging x-rays from the Bremsstrahlung production process.

DETAILED DESCRIPTION OF THE PREFERRED EMBODIMENTS

Figure 1:
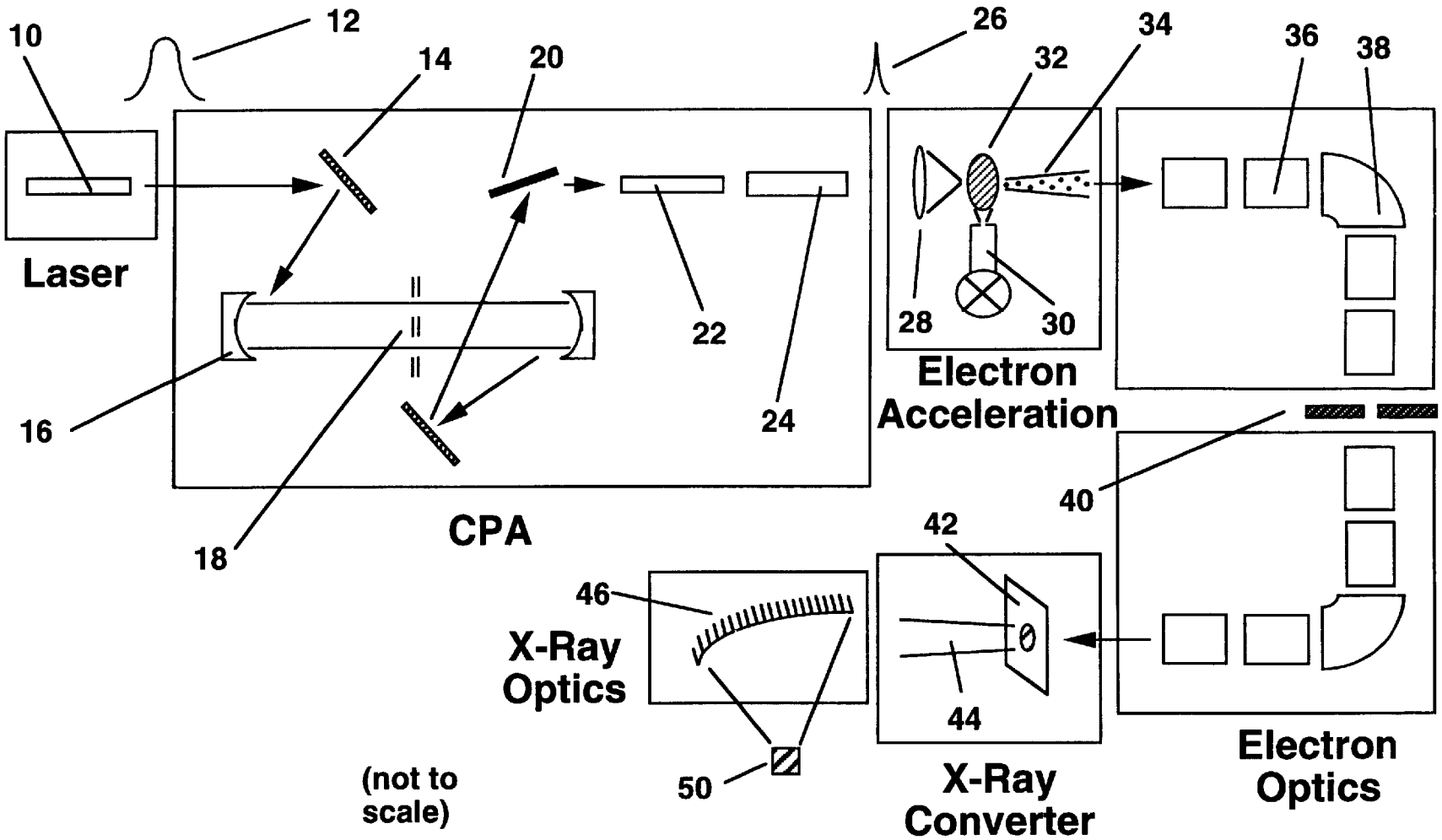
FIG. 1. shows the major components of a laser accelerator femtosecond x-ray source device with the most flexibility for electron beam and x-ray beam transport and energy selectivity.

The following material contains detailed descriptions and the projected performance parameters of LAFXS configurations, as well as comparisons with other techniques to produce extremely short pulses of x-rays. A schematic of the LAFXS, as described in the previous section, is shown in FIG. 1. A source laser 10 provides and initial laser pulse 12 (e. g., a NdYAG glass laser with mode locking and output at 1.06 microns wavelength and several tens of Joules of energy per pulse). This pulse enters the chirped pulse amplifier (CPA) which consists of optical gratings 14 to spatially separate out the pulse Fourier components, a pulse stretching cavity 16, with an embedded mask 18 to modify the phase/amplitude of the now spatially separated pulse Fourier components, and alignment mirror 20 to steer the laser pulses into a laser amplifier 22 and pulse re-compressor 24. The CPA produces a greatly shortened laser pulse 26 of duration several hundred femtoseconds ($10^{-15}$ sec) at a pre-selected location downstream. Laser optics 28 (optional location) produce a diffraction limited focal spot, typically of the order of a few microns or more in diameter. A gas jet 30 provides maximum density gas at the location of the laser beam focal plane 32 which serves as the plasma source. The laser beam, typically with intensities of $10^{18}$–$10^{21}$ W/cm$^2$ at the focal plane, ionizes the gas creating a plasma source of electrons for acceleration. The acceleration mechanisms, which include ponderomotive acceleration of low energy electrons produced by plasma wake field effects, produces a low emittance, high energy electron beam 34. Beam emittances as low as 0.1πmillimeter-milliradians can be produced due to the high axial velocities imparted to the electrons by the accelerating He forces. If necessary, the electron beam, with energies up to several tens of MeV (for currently available laser powers), can be transported through doublet or triplet configurations of quadrupole focusing magnets 36 and spatially spread by a dipole bending magnet 38, which imparts a slightly different exit direction to electrons of different energies. The placement of an exit collimator slit 40 allows selection of the range of electron energies desired, with the whole beam transport system operating as an electron spectrometer. If desired, a mirror image of this electron beam transport system can be added (after the slit location) to produce a tightly focused electron beam at the location of the x-ray converter device. In a preferred embodiment, the electron beam is tightly focused onto a high atomic number (Z) foil 42 (e. g., uranium, Z=92), to produce x-rays by the Bremsstrahlung collision process. The x-rays produced will be narrowly emitted in a beam in the forward direction 44 due to relativistic scattering effects when the electron energies exceed several times the rest mass of the electron (about 511 keV). The x-ray angular distribution for non-relativistic electrons has a $\sin^2(\theta)$ dependence. X-ray optics, such as curved grazing incidence mirrors 46 can be used to concentrate the x-ray beam onto the sample 50 material under study.

Figure 2:
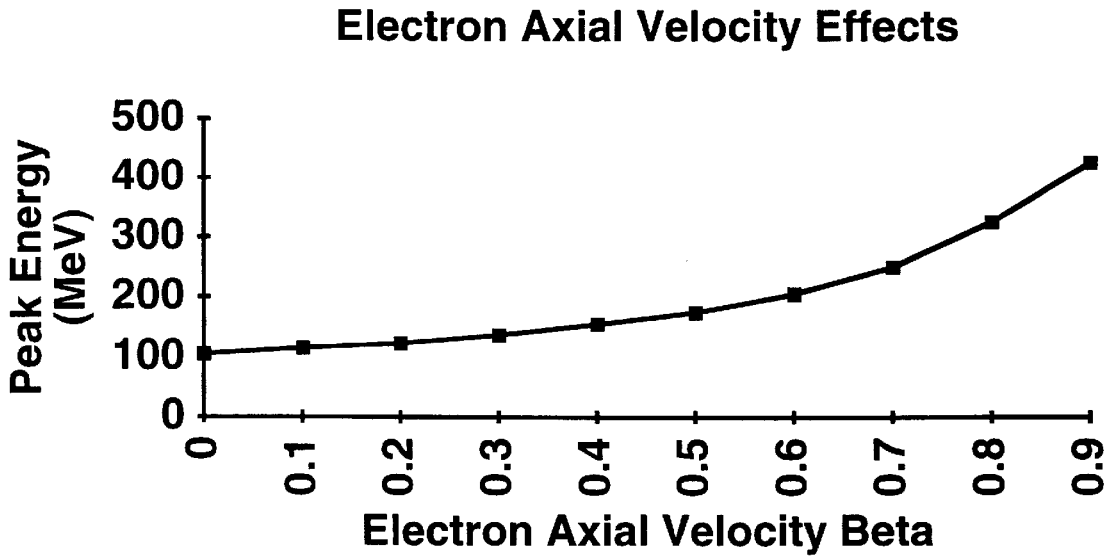
FIG. 2. illustrates the dependence of peak electron energy as a function of laser electric field strength and wavelength.
Figure 3:
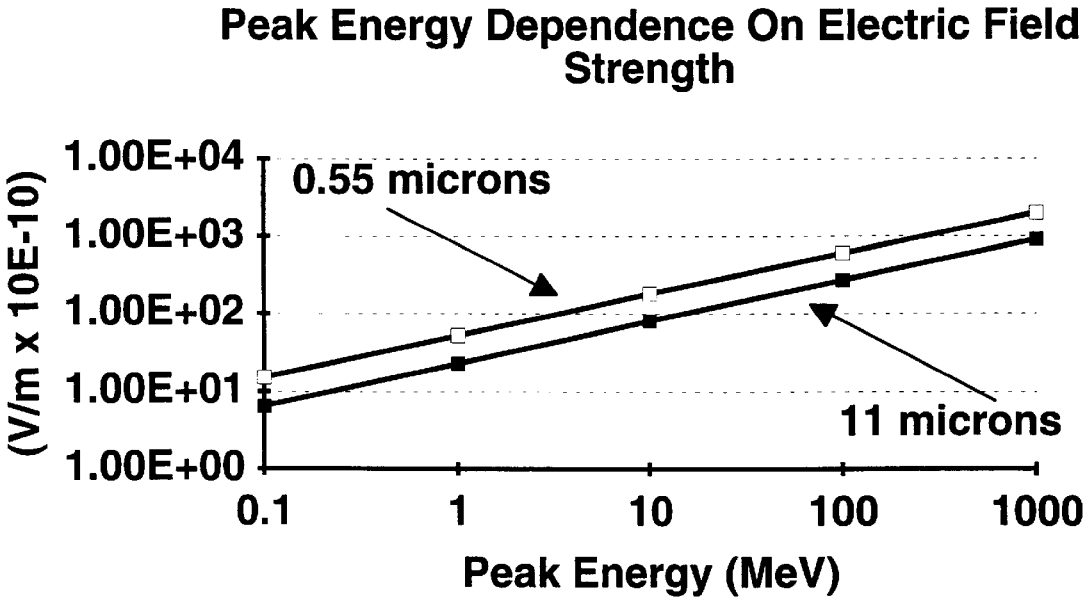
FIG. 3. illustrates the dependence of the peak electron energy on the axial velocity of the electron prior to laser acceleration, but for the non-physical case of a laser plane wave, as opposed to a Gaussian laser beam, which results in higher energies than would be obseved in experiments.

Performance estimates of the laser acceleration process are as follows, with detailed analyses appearing in previously listed references (see N. C. Schoen journal publications and patent references cited). The Schoen patent reference shows a graph of electron energy as a function of axial distance from the focal plane, for a single electron undergoing acceleration by a 0.55 micron high power laser. The laser pulse has a rise time of 100 femtoseconds, the electric field strength has a peak value of $6\times10^{13}$ volts/meter at the focal plane and the beam waist has about a 10λ(5 micron) radius. The peak power at the focal plane can be estimated using the Poynting vector formula $$S=(1/\mu_0 c)E^2$$

which results in a power level of $10^{21}$ W/cm$^2$. As shown in FIG. 2, for a given desired peak electron energy, laser electric field strength scales linearly with laser wavelength. Thus for the above conditions, electrons can be accelerated to the order of 50 MeV, which is consistent with the recently reported experimental results for lasers of comparable powers and spot sizes. It should be noted that at very high laser power densities, self-focusing of the laser beam can increase peak intensities by factors of five or more, which enhances the acceleration process. Also, the peak acceleration depends on the initial axial velocity of the electrons, as shown in FIG. 3, but for a perfect plane wave as opposed to a Gaussian beam (this produces higher energies than in the following figure). The electron divergence angles at maximum energy approach 5° or 100 milliradians. Using a beam waist of about 5 microns yields a rough estimate of the accelerated electron beam emittance of 0.16πmillimeter-milliradians, also comparable to that measured in recent experiments using 1.06 micron lasers. Finally, an estimate of the number of electrons accelerated can be made from the size of the Rayleigh region and the density of the plasma. With plasma densities of up to $10^{19}$ per cm$^3$ possible, and laser spot sizes of roughly 10 microns, one can calculate for interaction regions of about ⅓ the Rayleigh length, the maximum number of electrons accelerated will approach $5\times10^{10}$. Experiments have documented levels from $10^7$–$10^9$ electrons.

Next, estimates of the properties of the x-rays generated by various processes will be examined to estimate the performance of LAFXS as an x-ray source. The preferred x-ray conversion technique is via the Bremsstrahlung process, in which the laser accelerated electrons (with energy filtering if required) are made to impinge on a metal foil composite, and collisions with the atomic electrons create a Bremsstrahlung spectrum, with line radiation superimposed. An empirical relation for the fraction of electron kinetic energy E converted into x-ray energies W is ("Fundamentals of Modern Physics", R. M. Eisberg, John Wiley & Sons, 1964)

$$W/E=kZE$$

where $$k=0.7\times10^{-4} \text{ (all units in MeV).}$$

Thus, for MeV electrons conversion efficiencies can be relatively high (about 1% or more). The differential radiation cross section for the Bremsstrahlung x-ray beam produced can be written as ("Classical Electrodynamics", J. D. Jackson, John Wiley & Sons, 1962)

$$\frac{d\sigma(\omega)}{d\Omega} = A\ln\left(\frac{2\lambda\gamma^2 Mv^2}{\hbar\omega(1+\gamma^2\theta^2)}\right)\frac{3}{2\pi}\left[\frac{\gamma^2(1+\gamma^4\theta^4)}{(1+\gamma^2\theta^2)^4}\right]$$

where the constant A is $$A = \frac{16}{3}\frac{Z^2e^2}{c}\left(\frac{z^2e^2}{Mc^2}\right)^2\left(\frac{c}{v^2}\right)$$

Thus for relativistic electrons ($\gamma\theta >> 1$), the angular fall-off is proportional to $1/(\gamma\theta)^4$ and the x-ray beam is peaked strongly in the forward direction. For example, for 5 MeV electrons, the x-ray beam FWHM is <6°.

Figure 4:
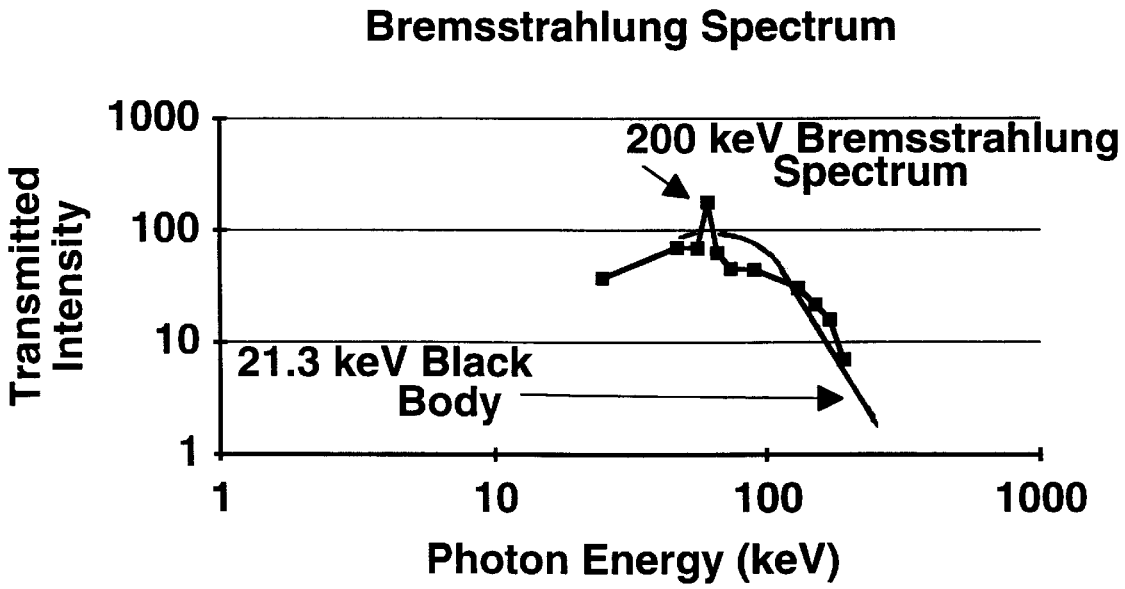
FIG. 4. shows a comparison of a Bremsstrahlung x-ray spectrum resulting from a 200 keV electron beam striking an optimized high Z=74 foil target (tungsten) with that of the best fit black body spectrum to Bremsstrahlung data generated by the CYLTRAN computer code.

An optimized Bremsstrahlung converter foil consists of a high Z foil (typically from Z of copper up to that of uranium) of thickness about ⅓ the electron range, usually backed by a thin low Z foil to stop the electron beam, but not severely attenuate the x-rays (if necessary for the application). The actual x-ray spectrum must be calculated by computer, since there is an electron energy spread and divergence, and integration must be performed over all varying parameters. An example x-ray spectrum, and comparison with a black body spectrum, is shown in FIG. 4. The data was produced using the CYLTRAN Code developed by J. Halbleib at Sandia National Laboratory. The conversion between black body and x-ray Bremsstrahlung spectra with total energy $E_{Br}$ is $$I(E) = \frac{15E_{Br}}{\pi^4 kT}\left[\frac{(E/kT)^3}{(e^{E/kT}-1)}\right]$$

For the sub-MeV electron range, the black body temperature is about ⅒ of the electron energy for a mono-energetic beam. The line radiation appearing in the figure is due to an inner shell x-ray transition on the tungsten (Z=74) target, and the intensity of the line radiation scales approximately as $(E-E_T)^{1.5}$ where $E_T$ is the energy of the x-ray transition. Thus the height of the line radiation increases as the electron energy exceeds the threshold value. It is also possible to forgo laser acceleration and use high current field emission diodes to produce multi-kiloampere electron beams, in which the anode is a Bremsstrahlung converter foil material (or the convertor foil is directly behind a thin high temperature anode foil). These devices will not be able to produce the very short pulse x-rays due to the high circuit impedance of large capacitive storage transmission lines and field emission diode inductance, but may be suitable for semiconductor manufacturing processes, such as chip mask production. The conclusion to be drawn from all the calculations above is that the Bremsstrahlung conversion technique offers relatively high efficiency and low beam divergence necessary for many applications.

Figure 7:
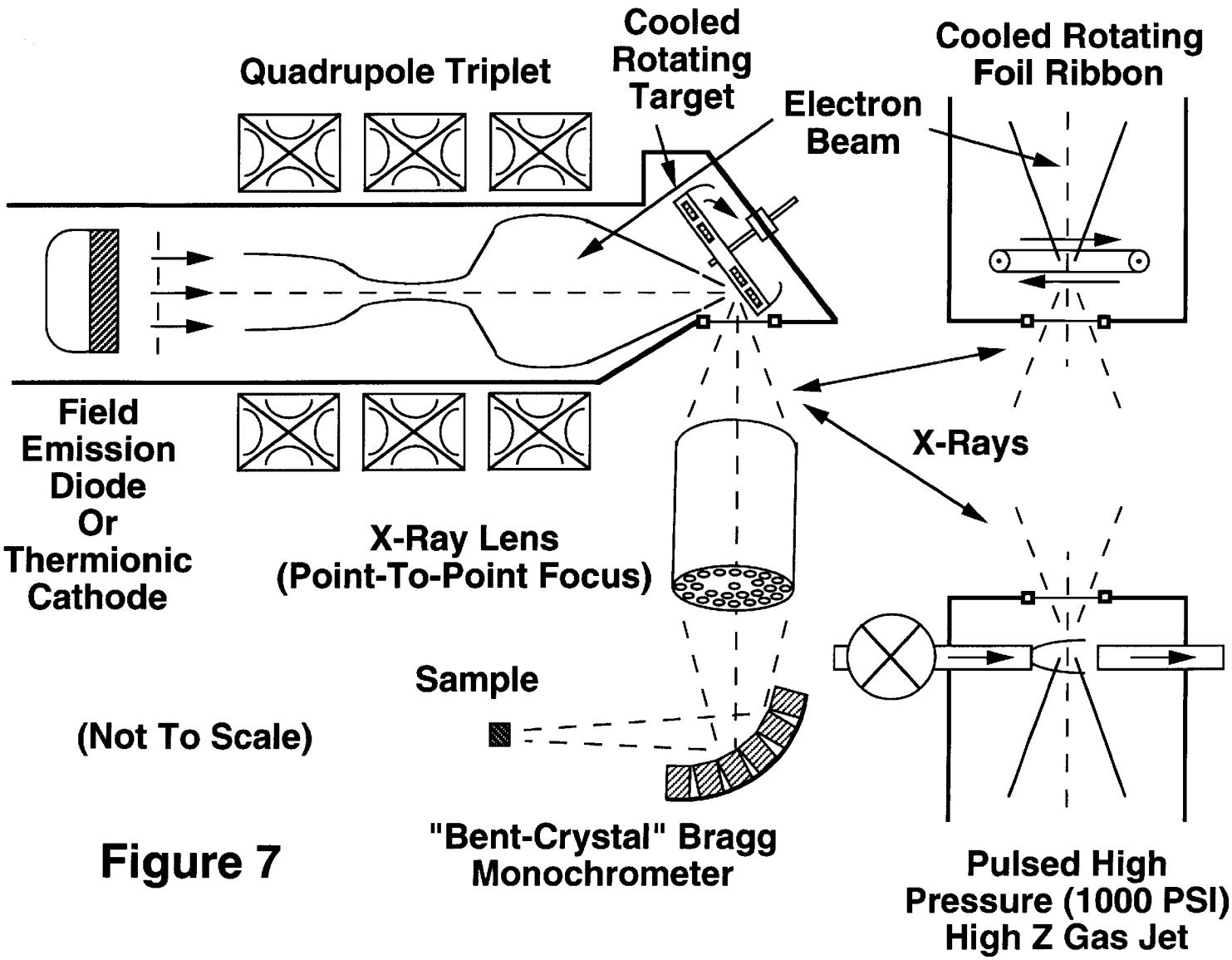
FIG. 7. illustrates several techniques and configurations for converting the electron beam to x-rays, along with polycapillary x-ray optics and an energy filtering crystal monochrometer, as well as showing a conventional electron beam generation and magnetic focusing front end system.
Figure 9:
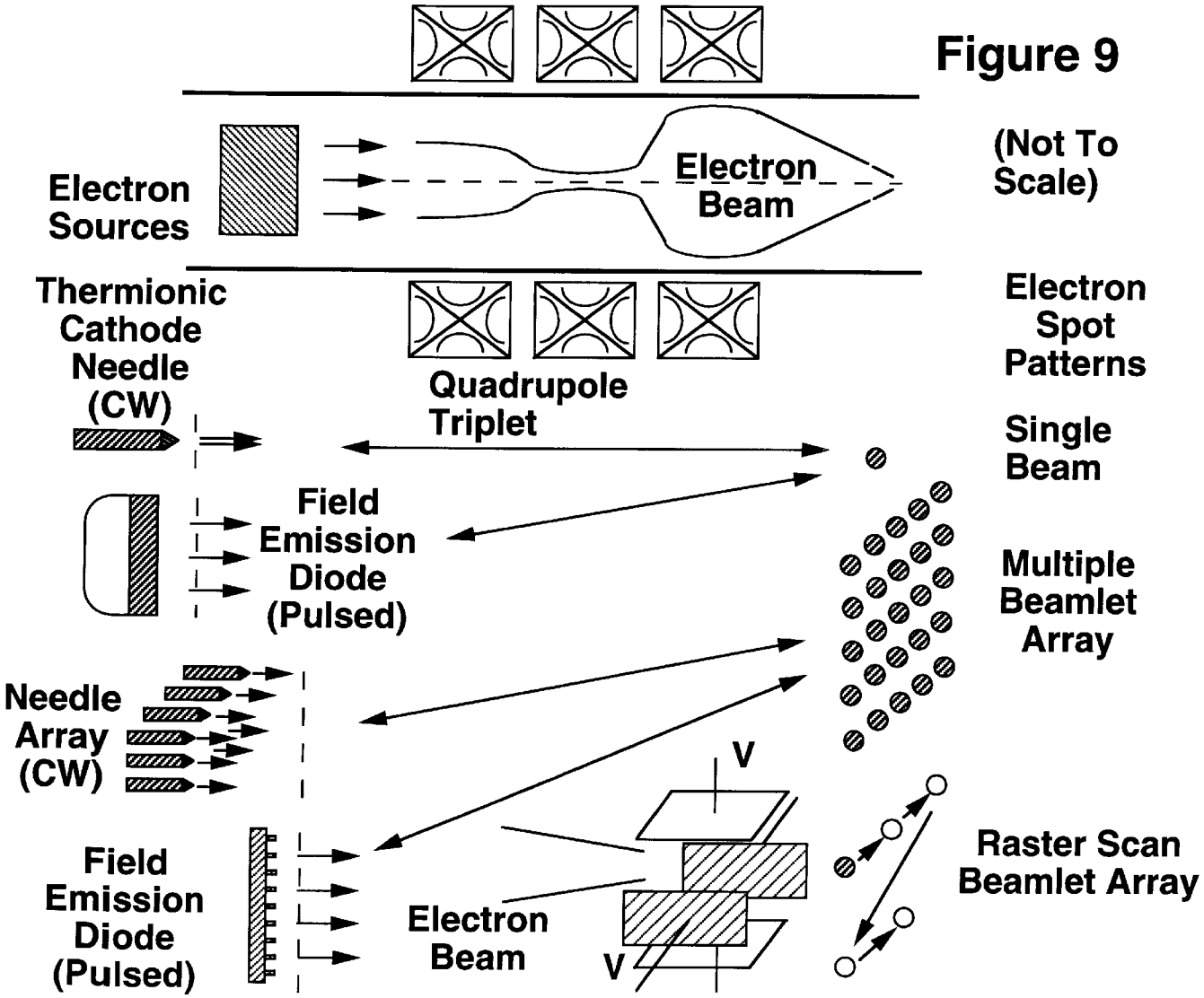
FIG. 9. shows details of electron beam generation techniques to produce the desired electron beamlets necessary for high efficiency collection of subsequent x-rays produced by a Bremsstrahlung process.

A key factor in generating the high x-ray fluxes and small spot sizes for both thermionic/field emission electron beam sources and the laser accelerator based electron beam technique, and necessary for many applications, is the use of newly developed polycapillary x-ray optics collimators and lenses (see M. A. Kumakhov, Nucl. Instrum. Meth. B48 (1990) pg. 283–286), as shown in several of the drawings (FIGS. 7, 8, and 9). Also contributing to the feasibility of the non-laser based approach is the use of innovative Bremsstrahlung conversion techniques, such as thin cooled (by contact with cooled spooling posts) moving ribbon foils (analogous to a typewriter ribbon) which operate as transmission target sources (as opposed to conventional backscatter, shallow pick-off angle anodes), and high pressure pulsed gas jets (of high Z atomic gaseous elements) that approach 1% of the density of solids, in addition to more conventional techniques such as rotating anode x-ray sources currently on the market (which have reached thermal heating limits for tightly focused electron beam spots). These x-ray conversion processes are shown in FIG. 7. Finally, the use of electron emitting arrays or "beamlets" (thermionic or pulsed field emission types), coupled with small bundles of capillary x-ray transmitting fibers aligned with the beamlets, enables the high x-ray collection efficiency for large spot or dispersed electron beam source designs that overcomes limitations from the thermal effects of the high power electron beams.

Figure 10:
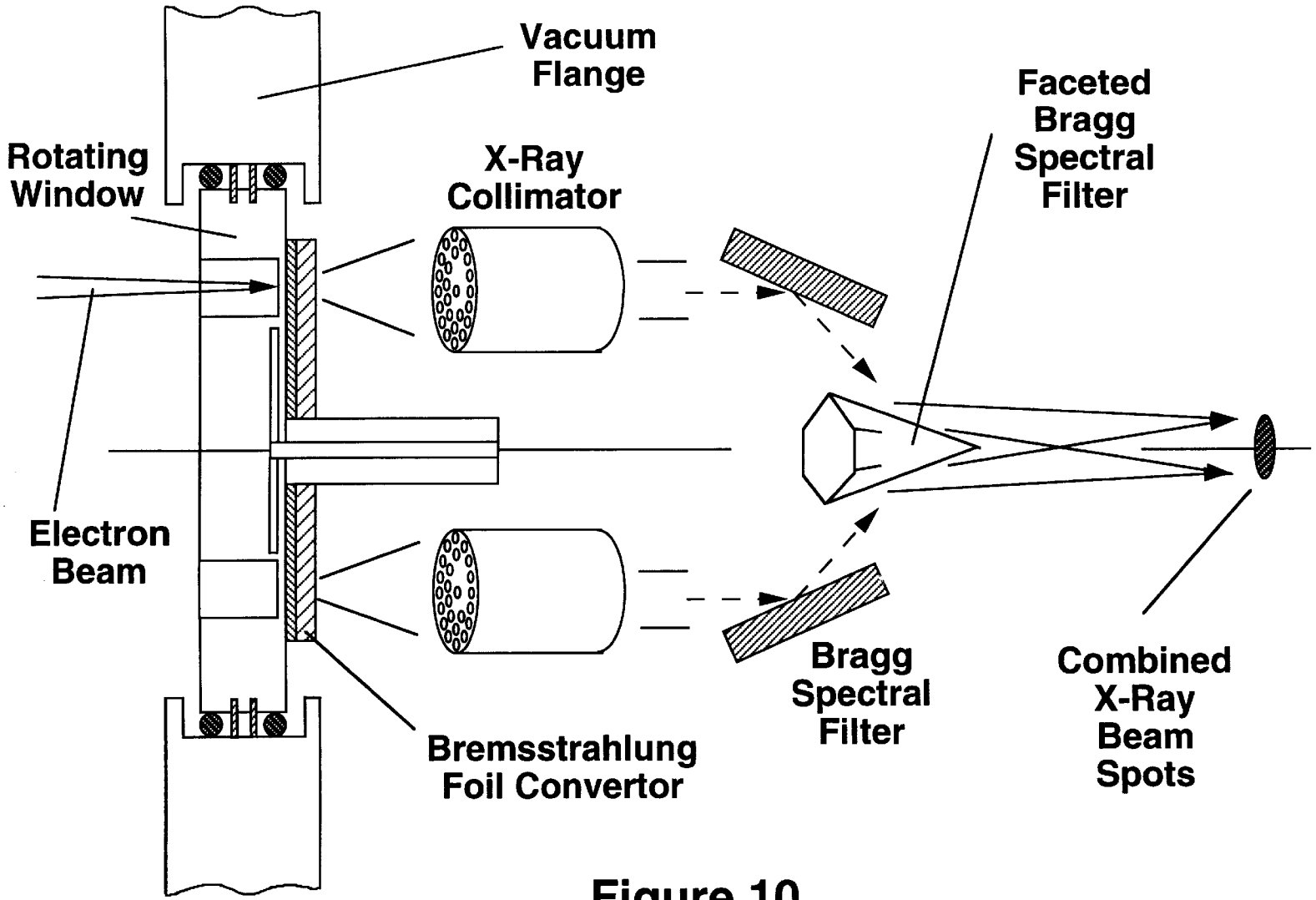
FIG. 10. shows a schematic of x-ray beam combining optics.

One of the primary innovations of this invention, as a preferred embodiment for long pulse x-ray beams not necessarily generated by laser acceleration techniques, is the use of multiple electron beamlets in conjuction with innovative x-ray beam combining techniques to produce fluxes of one or more orders of magnitude than currently available from thermal-limited rotating anode sources. FIG. 10 illustrates the use of a multi-faceted Bragg crystal reflector prism which can combine of the order of ten separate x-ray beams to produce a small, low divergence x-ray beam. The electron beams can generate x-rays by use of conventional Bremsstrahlung processes, from either backscatter cooled rotating anode tagets or forward transmission anode targets, and in this way avoid the current instantaneous thermal melt limitation on x-ray production from commercial x-ray source devices now in use. Although the transmission anode configuration shown in the figure produces a more compact device, it is also possible to use the standard commercial beveled rotating anode, which would require additional Bragg crystal reflectors to compensate for the large anglular spread to recombine x-ray beams due to the x-ray pick-off angle necessitated by the backscatter geometry. A compact multi-beam configuration is possible through the use of polycapillary x-ray collimating lenses, since conventional x-ray mirrors tend to be larger and less efficient at collecting x-rays from small, diverging point sources.

Another technique for generating x-rays from laser accelerated electrons involves Thomson scattering of a second laser pulse, usually oriented at 90° to the electron beam to minimize the x-ray pulse duration. The second laser photons are up-shifted in energy by the factor $$2\gamma^2/(1+\gamma^2\theta^2) \text{ (for 90° orientation)}$$

with a beam divergence of about $1/\gamma$. The number of x-ray photons can be calculated as (see Schoenlein reference)

$$N_{x\text{-}ray} = \frac{N_{laser}N_e\tau_{laser}}{A\tau_e}\sigma_T$$

where $\sigma_T$ is the Thomson electron scattering cross section, $\tau$ are the respective electron and laser pulse widths, and A is the interaction area. Experiments have demonstrated of the order of $10^5$ photons, using a synchrotron accelerator and tens of Joules of laser energy. It is also possible to utilize a magnetic "undulator", which consists of a short-wavelength spatially periodic variation in a magnetic field device, to produce x-rays from electron synchrotron beams, as is currently done in several national laboratories.

Finally, the short high energy laser pulse can be used directly to produce a black body plasma (see Malka, et. al. references), and calculations using the black body formula $$W=(5.672E-08)T^4 \text{ (Watts/m}^2\text{)}$$

on thin foils have confirmed expected x-ray fluxes of the order of $10^{10}$ x-ray photons/pulse. A direct comparison of these three x-ray conversion techniques (for experimental conditions) are shown is the table below.

| Technique | Number Of Photons (30 keV) | Number Of Electrons | Electron Energy (MeV) | Electron Energy Conversion | Divergence FWHM (radians) |
|---|---|---|---|---|---|
| Bremsstr'lg | $10^{10}$ | $10^{10}$ | 0.3 | 1% | 0.5 |
| Thomson | $10^{7}$ | $10^{10}$ | 50. | $10^{-4}$% | $10^{-2}$ |
| Black Body | $10^{10}$ | $10^{10}$ | 0.03 | 20% | $4\pi$ |

It is likely that the electron acceleration mechanisms discussed earlier operate in the case of direct laser bombardment of the thin foil, and are mechanisms for creating the high temperature plasma and possibly a fraction of the x-ray flux via Bremstrahlung radiation from plasma electrons accelerated by the two possible mechanisms (ponderomotive and plasma wake field).

Figure 5:
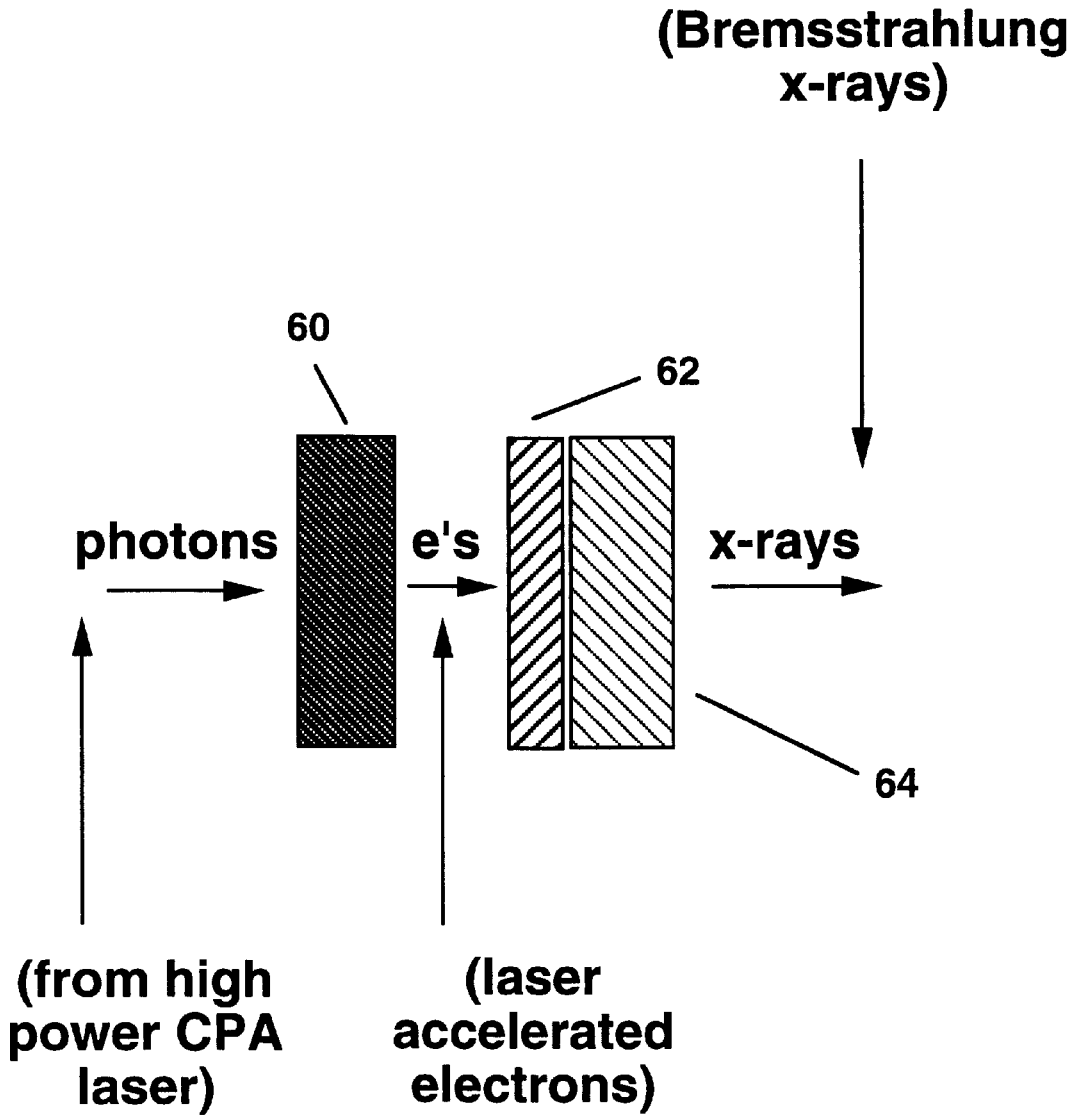
FIG. 5. shows a composite foil structure which provides material for a plasma source, which then has electrons ejected by the laser acceleration process which pass through a high Z foil of roughly one third the electron range, which produces Bremsstrahlung x-rays which enter a low Z foil which stops the electrons but allows the x-rays to exit for use in an application.
Figure 6:
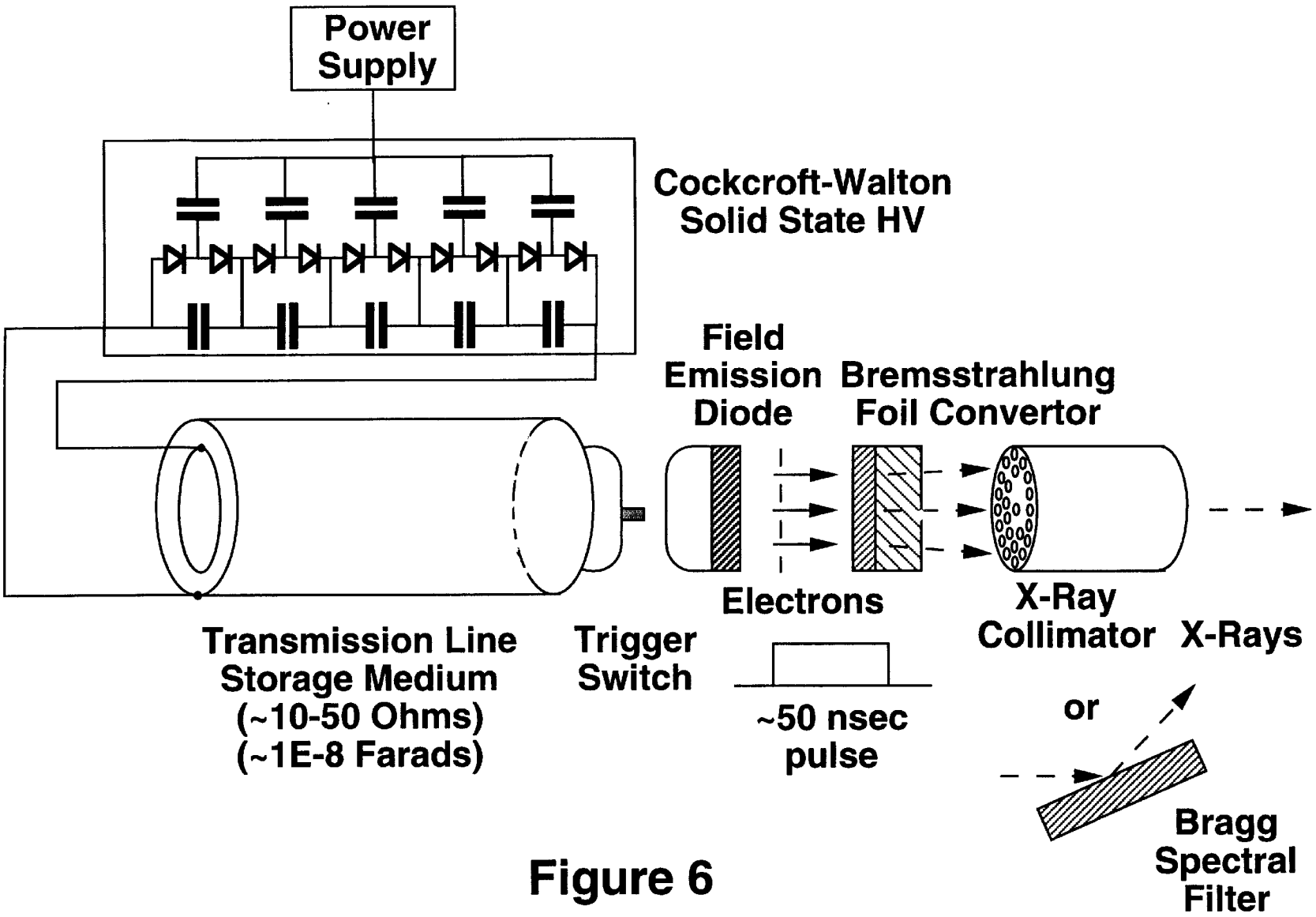
FIG. 6. shows a schematic of a field emission diode driven Bremsstrahlung x-ray source.

An alternate configuration may be possible if large energy and beam divergences are acceptable for the application desired. This configuration, shown in FIG. 5, consists of a foil "sandwich" of polymer 60 (e.g., CH), for producing the plasma for electron acceleration, and a Bremsstrahlung foil composite of high Z 62 and low Z 64 metals. The foil package can be designed to rotate to provide reduced servicing/replacement requirements. X-ray optics, as described earlier, can be added if some beam conditioning is required for the particular desired application.

In summary, the principle innovations developed herein are:

a high flux, femtosecond regime, well collimated and focused x-ray source driven by laser accelerated electrons, a high flux, long pulse (nanoseconds regime), well collimated and focused x-ray source driven by electron beams produced by field emission diodes or multi-beam thermionic cathodes, and an innovative x-ray beam combining technique utilizing polycapillary x-ray lenses and Bragg crystal reflectors in conduction with a multi-faceted Bragg crystal prism to collect and re-direct x-ray beamlets. All of these devices rely primarily on thin foil Bremsstrahlung x-ray convertors, as opposed to direct plasma x-ray production or use of transition radiation as described in prior art citations.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A laser electron accelerator driven sub-picosecond time scale x-ray source device with enhanced output produced by coherent x-ray production and a multi-beam combining optics system, for application to structure and reaction studies of biological molecules, high resolution medical imaging, and structure and behavior studies of semiconductor devices, comprising;

multi-Joule energy input laser means to provide initial high energy laser pulse which can be subsequently compressed in pulse duration to achieve femtoseconds time ranges;

laser pulse compression means to achieve femtoseconds range output pulses from said input laser means;

electron or plasma production means to provide a source of electrons for a laser acceleration process using said femtoseconds range output pulses;

electron acceleration means using said laser output pulses chromagnetic forces applied to said source of electrons to cause phase bunching at intervals selectable by the wavelength of said input laser means and accelerating them to multi-MeV energy levels;

coherent Bremsstrahlung and line radiation x-ray conversion means using the spatial and temporal periodicity of said electron phase bunching and an electron beam target periodic atomic structure to convert said laser accelerated electrons to x-ray photons suitable for application requirements, and;

x-ray optics components means to transport, combine, filter and focus said x-ray photons to produce a desired x-ray beam photon flux and divergence angle at a location of an application sample material under study.

2. A device according to claim 1 wherein said source of electrons for laser acceleration are provided by a high voltage field emission process from a needle or planar diode coated electrode surface.

3. A device according to claim 1 wherein said plasma production means to provide a source of electrons for said laser acceleration process is selected from the group consisting of; said femtoseconds range output pulse and a second laser, which impinges upon a target, selected from the group consisting of foils and pulsed gas jets.

4. A device according to claim 1 wherein said multi-Joule laser pulses are comprised of a number of spatially separated laser pulses, each of which is separately compressed to achieve said femtoseconds range output, and;

wherein said x-ray optics components means consists of x-ray polycapillary collimation lenses and Bragg reflecting crystals arranged so as to form an x-ray beam combining device to focus individual x-ray beams to a single spot with low divergence angles.

5. A device according to claim 1 wherein the mechanism said laser output pulses which accelerates electrons to said multi-MeV energy levels is selected from the group consisting of; the ponderomotive force of said laser output pulses electromagnetic fields, the plasma wake field electrostatic or electromagnetic forces, and a combination of both ponderomotive and plasma acceleration mechanisms.

6. A device according to claim 1 wherein said x-ray conversion means is selected from a group consisting of; Thomson scattering of a separate laser source photons off of laser accelerated electrons and Bremsstrahlung scattering with line radiation of said laser accelerated electrons in low to high Z material selected from the group consisting of; quasie-periodic solid and high pressure gaseous forms.

7. A device according to claim 1 wherein said x-ray conversion means to convert said laser accelerated electrons to x-ray photons consists of a thin low to high Z foil of uniform crystalline structure to provide increased coherence in said x-ray photons output at wavelengths equal to integer multiples of the foil crystal lattice spacing, and;

said multi-Joule energy input laser have a wavelength of the order of said crystal lattice spacing thus providing electron bunching at intervals equal to said foil crystal lattice spacing, which provides further increases in the coherence of said x-ray photons output.

8. A device according to claim 1 wherein said x-ray conversion means to convert said laser accelerated electrons to x-ray photons consists of a thin low to high Z foil of uniform crystalline structure to provide increased coherence in said x-ray photons output at wavelengths equal to integer multiples of the foil crystal lattice spacing.

9. A long pulse (nanoseconds regime) electron emitting array driven x-ray source device for application to structure and reaction studies of biological molecules, high resolution medical imaging, and semiconductor processing, comprising;

electron emitting array means to produce kiloampere or greater electron beam pulses of energies from the K-edge of beryllium up to several hundred keV, said electron beam pulses produced by a discharge from a cylindrical capacitive storage device which discharges in transmission line fashion to produce a rectangular high voltage pulse of up to said several hundred keV which is applied to said electron emitting array;

electron beam optics components means to transport, filter and focus accelerated electrons;

x-ray conversion means to convert said electron beam pulses into x-rays, including low to high Z Bremsstrahlung foils backed by low Z electron stopping foils, which produce Bremsstrahlung and line x-ray radiation output and;

x-ray optics components means to transport, combine, filter and focus said x-ray photons to produce a desired x-ray beam photon flux and divergence angle at a location of an application sample material.

10. A device according to claim 9 for application to structure and reaction studies of biological molecules wherein said electron emitting array means is selected from a group consisting of; multiple field emission diodes and field emission diodes with machined and conditioned surfaces which form electron beamlet emitters, and;

wherein said x-ray optics components means consists of x-ray polycapillary collimation lenses and Bragg reflecting crystals arranged so as to form an x-ray beam combining device to focus individual x-ray beams to a single spot of the order of less than several millimeters diameter with low divergence angles.

11. A device according to claim 9 for application to structure and reaction studies of biological molecules wherein said electron emitting array means comprises multiple thermionic emission cathodes with electron guns and accelerating anodes, and;

wherein said x-ray optics components means consists of x-ray polycapillary collimation lenses and Bragg reflecting crystals arranged so as to form an x-ray beam combining device to focus individual x-ray beams to a single spot of the order of less than several millimeters diameter with low divergence angles.

12. A device according to claim 9 for application to high resolution medical imaging and semiconductor processing wherein said electron emitting array means comprises multiple thermionic emission cathodes with electron guns and accelerating anodes, and;

wherein said x-ray optics components means consists of x-ray polycapillary collimation lenses and Bragg reflecting crystals arranged so as to form an x-ray beam combining device to focus individual x-ray beams to a large area with low divergence angles.

13. A device according to claim 9 for application to high resolution medical imaging and semiconductor processing wherein said electron emitting array means is selected from a group consisting of; multiple field emission diodes and field emission diodes with machined and conditioned surfaces which form electron beamlet emitters, and;

wherein said x-ray optics components means consists of x-ray polycapillary collimation lenses and Bragg reflecting crystals arranged so as to form an x-ray beam combining device to focus individual x-ray beams to a large area with low divergence angles.

14. A device according to claim 9 wherein said x-ray conversion means to convert said electrons to x-ray photons contains a thin low to high Z foil of uniform crystalline structure to provide increased coherence in said x-ray radiation output.

* * * * *